United States Patent [19]

Sittmann

[11] 3,971,567

[45] July 27, 1976

[54] SAFETY SKI BINDING

[75] Inventor: Brigitte Sittmann, Stuttgart, Germany

[73] Assignee: Vereinigte Baubeschlagfabriken Gretsch and Co. GmbH, Germany

[22] Filed: June 11, 1974

[21] Appl. No.: 478,358

[30] Foreign Application Priority Data

June 12, 1973 Germany ..... 2329832
Feb. 20, 1974 Germany ..... 2408162

[52] U.S. Cl. ..... 280/618; 280/636
[51] Int. Cl.[2] ..... A63C 9/08
[58] Field of Search ..... 280/11.35 K, 11.35 T, 280/11.35 C, 11.35 R, 11.35 H, 11.35 G

[56] References Cited

UNITED STATES PATENTS

| | | | |
|---|---|---|---|
| 2,586,339 | 2/1952 | Hvam | 280/11.35 T |
| 2,676,813 | 4/1954 | Beyl | 280/11.35 Y |
| 3,410,568 | 11/1968 | Wiley | 280/11.35 K |
| 3,476,400 | 11/1969 | Unger | 280/11.35 C |
| 3,489,424 | 1/1970 | Gertsch et al. | 280/11.35 K |
| 3,677,567 | 7/1972 | Salomon | 280/11.35 C |
| 3,727,933 | 4/1973 | Allsop | 280/11.35 C UX |
| 3,731,945 | 5/1973 | Johnson | 280/11.35 C |
| 3,785,668 | 1/1974 | Marker | 280/11.35 R |
| 3,845,964 | 11/1974 | Johnson | 280/11.35 K |
| 3,866,928 | 2/1975 | Gertsch et al. | 280/11.35 K |

FOREIGN PATENTS OR APPLICATIONS

| | | | |
|---|---|---|---|
| 652,637 | 11/1962 | Canada | 280/11.35 C |

*Primary Examiner*—M. H. Wood, Jr.
*Assistant Examiner*—Milton L. Smith
*Attorney, Agent, or Firm*—Craig & Antonelli

[57] ABSTRACT

A safety ski binding with forward and/or rear retaining mechanisms which releasably retain the ski boot is rotatably supported on the ski, against a lifting off from the ski and against lateral deflections; for purposes of rotatable support of the ski boot about an axis perpendicular to the ski, a retaining member is rotatably supported on the ski about this axis, which holds the ski boot by means of lateral extension against a lateral displacement in the ski transverse direction; the extensions couple with each other the retaining member and the ski boot in the direction of rotation, yet permit a lifting off of the ski boot from the ski in a direction perpendicular to the ski surface.

40 Claims, 20 Drawing Figures

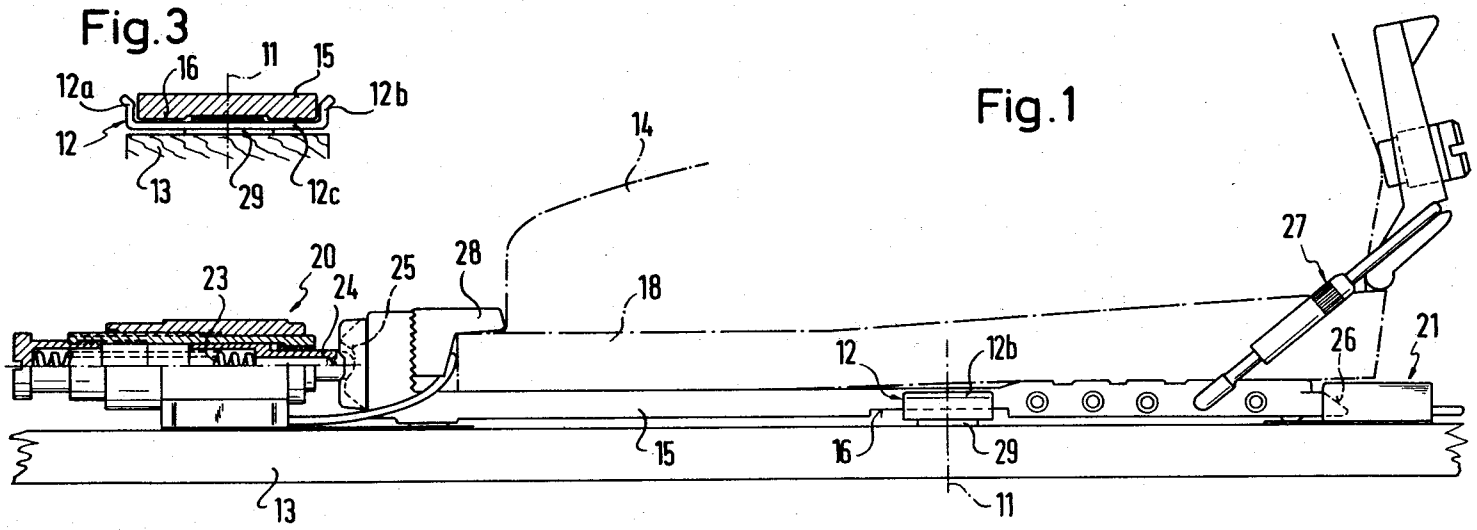
Fig. 1
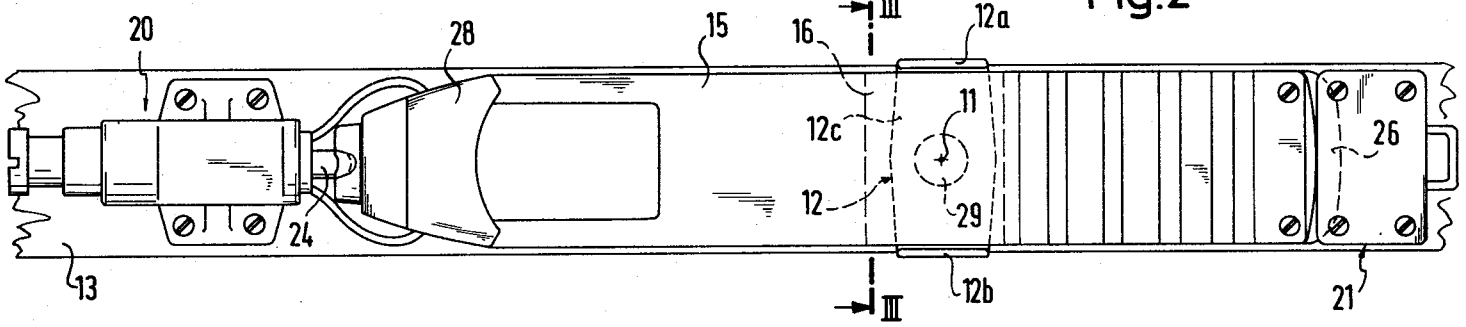
Fig. 2
Fig. 3

FIG. 18
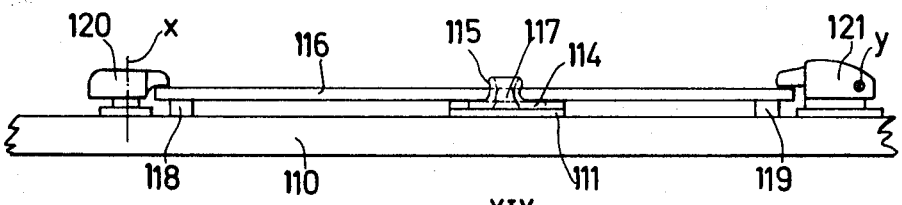
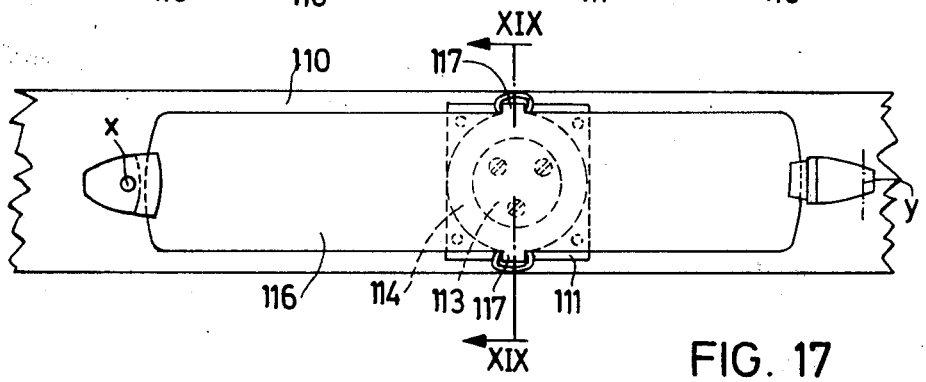
FIG. 17
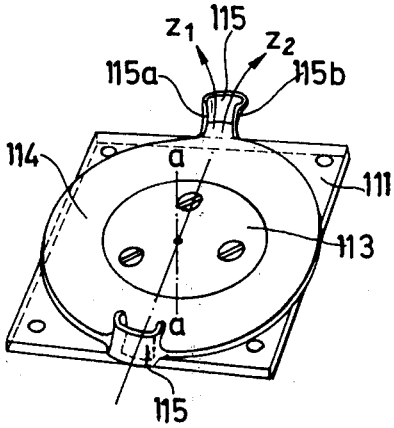
FIG. 20
FIG. 19
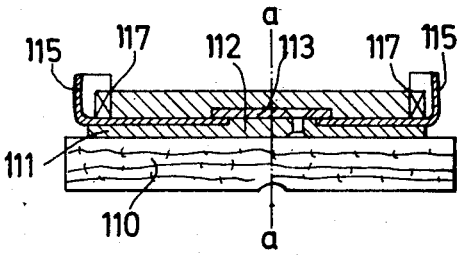

SAFETY SKI BINDING

The present invention relates to a safety ski binding with a front and/or rear hold-down or retaining mechanism which releasably holds the ski boot that is rotatably supported to the ski, against a lifting off from the ski and against lateral deflections.

Safety ski bindings of this type are known in the art in which a sole plate latched forwardly or rearwardly to the ski is rotatably supported to the ski by means of a pivot pin which is secured to the ski and engages from below into a cylindrical bore of the sole plate. By reason of the non-visible arrangement of the pivot pin underneath the sole plate, certain difficulties are encountered by the skier, for example, when stepping again into the binding after a fall, to bring the pivot pin into engagement again with the bore in the sole plate.

Furthermore, safety ski bindings of the aforementioned type are known in the art in which in the case of the use of a sole plate, an elongated aperture or opening is provided in the sole plate into which engages a pin fixed to the ski. A limited longitudinal displaceability of the sole plate relative to the ski is acheived in this manner which is appropriate, for example, because in case of a so-called forward sliding fall, a certain longitudinal displaceability of the sole plate with respect to the forward hold-down or retaining mechanism must be possible in order to achieve a release at the rear hold-down or retaining mechanism. Additionally, the arrangement of the sole plate in the longitudinal direction should be determined generally by the forward and rear retaining device, not, however, by the pivot pin.

However, also with these known safety ski bindings, it frequently involves difficulties to step again into the binding with the sole plate after a fall.

The aim of the present invention therefore essentially consists in providing a safety ski binding of the aforementioned type, which in conjunction with economical manufacturing ability and good functioning reliability entails no difficulties when stepping-in, and more particularly also not when a sole plate is secured to the ski boot. In connection therewith, in particular the important feature of the liftability of the sole plate from the ski in the upward direction in case of a fall is not to be abandoned.

Accordingly, the present invention essentially consists in that for the pivotal bearing support of the ski boot about an axis perpendicular to the ski, a retaining member is rotatably supported on the ski about this axis and the retaining member holds the ski boot by means of lateral extensions against a lateral displacement in the ski transverse direction, whereby the extensions couple with each other the retaining member and the ski boot in the direction of rotation, yet permit, in contradistinction thereto, a lifting off of the ski boot in a direction perpendicular to the ski.

In a particularly appropriate embodiment of the present invention, the ski boot by means of a sole plate adapted to be clamped thereto is held on the ski by the hold-down or retaining devices whereby the lateral extensions surround the sole plate on both sides.

Advantageously, the extensions are arranged so as to be visible when the ski boot is clamped-on and are constructed to enable a free insertion of the ski boot or of the sole plate from above. Preferably the retaining member is constructed as round rotary disk or plate.

In one special embodiment of the present invention, the retaining member or the sole plate is provided with upwardly directed fork-like or cup-like extensions, into which the lateral entrainment elements of the sole plate or of the retaining member are adapted to be freely inserted from above.

The skier has thereby the possibility to step with the sole plate into the lateral extensions from above, whereupon during the clamping of the forward and of the rear detent mechanism the sole plate is secured simultaneously against a lifting off from the ski. The contour of the fork- or cup-like extensions may also be so selected that with a release during a forward or rearward fall, the pins which are in engagement with the same, are able to describe a circular path about a forward or rearward support point. Additionally, in case of assembly inaccuracies or in case of special wishes of the skier, a simple displacement of the plate transversely to the ski is possible in that the walls of the extensions can be offset laterally or can be bent laterally.

In one preferred embodiment of the present invention, the rotatably supported retaining member has a play in the ski longitudinal direction with respect to the sole plate or the ski boot, which permits a longitudinal displacement of the ski boot with respect to the ski. The extensions may thereby contact the side edges of the sole plate or of the boot, however, preferably have a slight spacing therefrom whereby the stopping in and also the release are facilitated. Preferably, the extensions extend only approximately up to slightly below the surface of the sole plate.

Appropriately, the retaining member is provided intermediate the extensions with a plate area which is disposed in a corresponding recess in the bottom side of the sole plate. However, it is also possible and realizable without difficulty from a manufacturing point of view that the plateshaped retaining member together with the lateral extensions is inserted into the intermediate space between the sole plate and the ski surface so that the sole plate, in principle, requires no special machining in order to create a defined pivot point in case of the lateral release, yet not to impair the longitudinal displaceability of the sole plate and the lifting off in the upward direction.

Preferably, the lateral extensions extend over such a length that they serve as longitudinal guidance for the sole plate. The sole plate is guided in a completely satisfactory manner in the longitudinal direction with the so-called sliding forward falls whereas the release in the upward direction and toward the side is not impaired in any manner.

The pivot axis is located preferably in the rear half of the sole plate and preferably again in the forward area of this rear half.

The lateral extensions may engage with advantage into lateral notches or grooves of the sole plate. It is avoided thereby that the extensions project laterally beyond the side edges of the sole plate.

The lateral extensions engage according to a further simplified embodiment directly at the side edges of the boot sole. In this manner, the boot receives an unequivocal pivot point in case of a twisting release without the presence of a sole plate and without special means at the boot.

The retaining member consists preferably of synthetic plastic material of conventional type, such as synthetic resinous material so that its manufacture is economical and also the requisite rigidity and strength exists in case of falls.

According to a preferred embodiment, the retaining member is rigidly secured to the ski, and the lateral extensions cooperate with rounded-off, laterally projecting lugs or tabs on the sole plate. In this case, no separate special rotatable retaining member has to be provided at all; instead, the sole plate forms the rotatable retaining member itself by reason of its construction. The liftability in the upward direction and the longitudinal displaceability can be provided in the same manner as in the remaining embodiments of the present invention.

It is particularly advantageous if the retaining member is prestressed into its normal position because, as a result thereof, it will automatically assume again its normal position after a fall with the lateral extensions parallel to the ski longitudinal direction, and it does not have to be realigned with the sole plate for purposes of stepping in.

These and other objects, features and advantages of the present invention will become more apparent from the following description when taken in connection with the accompanying drawing which shows, for purposes of illustration only, several embodiments in accordance with the present invention, and wherein:

FIG. 1 is a side elevational view of a safety ski binding according to the present invention;

FIG. 2 is a plan view of the safety ski binding of FIG. 1;

FIG. 3 is a cross-sectional view taken along line III—III in FIG. 2;

FIG. 17 is a top plan view of a further embodiment of a safety ski binding according to the present invention;

FIG. 18 is a side elevational view of the safety ski binding according to FIG. 17;

FIG. 19 is a cross-sectional view taken along line XIX—XIX of FIG. 17; and

FIG. 20 is a perspective plan view of the rotary disk serving as bearing support for the sole plate.

Figure 4:
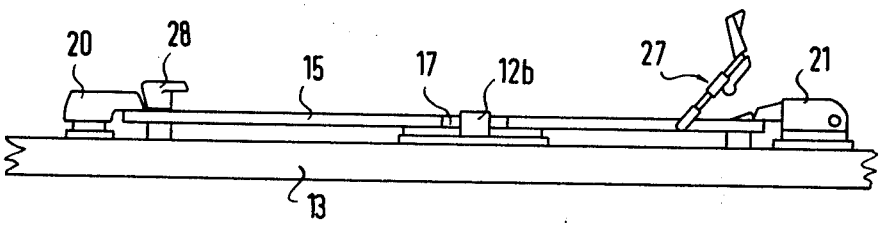
FIG. 4 is a schematic side elevational view of another embodiment of a safety ski binding in accordance with the present invention.

Referring now to the drawing wherein like reference numerals are used throughout the various views to designate like parts, and more particularly to FIGS. 1 to 3, according to this embodiment, a forward hold-down or retaining mechanism generally designated by reference numeral 20 and of conventional construction and a rear hold-down or retaining mechanism generally designated by reference numeral 21 and also of conventional construction are fixedly arranged on a ski 13. A spring 23 presses a piston 24 against an abutment 25 constructed as shown in the drawing which is fixedly arranged or mounted to a sole plate 15. In this manner, an extension at the rear end of the sole plate 15 which is provided with an inclined surface 26 is forced against a correspondingly inclined complementary surface of the rear retaining device 21. The surfaces are curved, as can be seen from FIG. 2, and more particularly with the vertical axis 11 as center point of curvature. In this manner, both a release of the sole plate 15 in the upward direction as also toward the side is possible. In case of a sliding forward fall, the spring 23 is compressed, and the extension at the rear end of the sole plate 25 which is provided with the surface 26 is able to leave the complementary recess in the rear retaining device 21.

On the sole plate 15 is shown a ski boot 14 with a sole 18 which is held fast by a conventional heel hold-down mechanism generally designated by reference numeral 27 engaging at the sole plate 15 and by a conventional toe hold-down mechanism 28 engaging over the front portion of the boot sole 18.

A retaining member generally designated by reference numeral 12 is arranged according to the present invention underneath the sole plate 15 somewhat behind the center of the sole plate; the retaining member 12, according to FIG. 3, includes a plate-shaped bottom part 12c and two lateral, upwardly projecting extensions **12*a* and 12*b*. The area 12*c* of the retaining member 12 is rotatably supported at the ski about the vertical axis 11, for example, by means of a pivot pin 29. The lateral extensions 12*a* and 12*b* enclose the sole plate 15 with the slight lateral play which can be seen from FIG. 3. The extensions 12*a* and 12*b*, however, may also contact the side edges of the sole plate 15** so that a snug fit exists.

Within the area of the retaining member 12, the sole plate 15 is provided at its bottom with a recess 16 which extends beyond the retaining member 12 in the longitudinal direction on both sides. The recess 16 has to be of such length that the retaining member 12 does not impair the longitudinal displaceability of the sole plate 15 in case of a release.

Preferably the retaining member 12 has precisely the shape and form which can be seen from FIGS. 1 to 3 which offers advantages both as regards manufacture as also as regards use. The good guidance of the sole plate 15 by the retaining member 12 in the longitudinal direction should thereby be particularly mentioned. It is thereby significant that in contrast to the known constructions with an elongated aperture, the side edges of the sole plate 15 abut the extensions **12*a* and 12*b*** over the entire length thereof, whence lateral forces are distributed very uniformly over the retaining member 12 and therewith over the ski 13.

The operation of the binding illustrated in FIGS. 1 to 3 is as follows:

If a twisting release takes place out of the position illustrated in FIG. 1, then the sole plate 15 is rotated in a defined manner about the pivot pin 29 or about the pivot axis 11. If a sliding forward fall should occur, the longitudinal movement of the sole plate 15, on the other hand, is not impaired. Also the lifting off out of the retaining member 12 in the upward direction is feasible without any difficulty.

The manufacture is very economical because with the exception of the recess 16, which additionally may be omitted, no special measures as regards manufacture are required for the sole plate 15.

In the remaining figures, corresponding parts are designated by the same reference numerals as in FIGS. 1 to 3.

Figure 5:
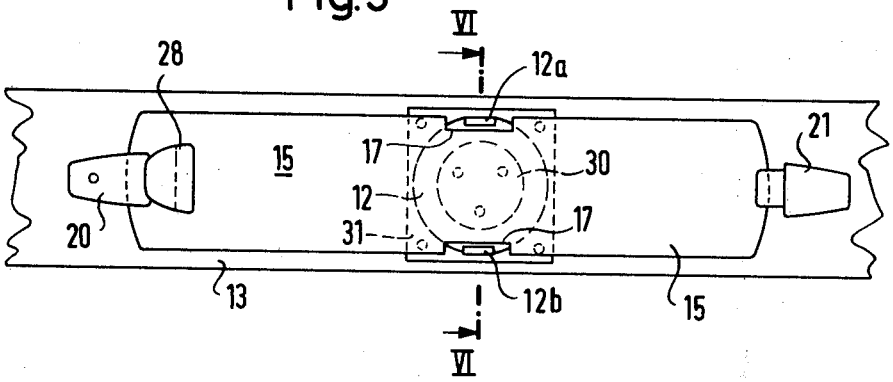
FIG. 5 is a plan view of the safety ski binding of FIG. 4.
Figure 6:
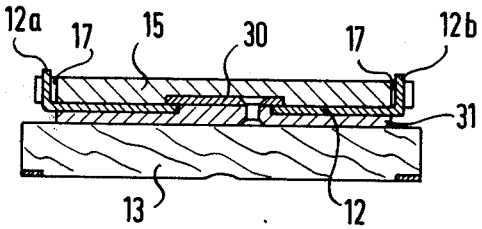
FIG. 6 is a cross-sectional view, taken along line VI—VI in FIG. 5.

In the embodiment according to FIGS. 4 to 6, the retaining member is constructed as rotating disk or plate 12 which, according to the present invention, is rotatably supported at the ski by means of a fastening or mounting plate 30. A recess for the accommodation of the fastening plate 30, if necessary, is present in the bottom side of the sole plate 15. With a sufficient spacing of the sole plate 15 from the ski 13, such a machining of the bottom side of the sole plate 15, however, may be dispensed with.

According to the present invention, notches or cuts 17 are provided in the sides of the sole plate 15 within the area of the vertical extensions 12*a* and 12*b* or the rotary plate 12, into which engage the extensions 12*a* and 12*b*. Like the recess 16 in the embodiment according to FIG. 1, the notches 17 are longer in the longitudinal direction that the extensions 12*a* and 12*b* so that the sole plate 15 is fixed by the extensions 12*a* and 12*b* in the lateral direction but not in the longitudinal direction. Also the lifting off in the upward direction is possible without difficulty. In the embodiment according to FIGS. 4 to 6, the extensions 12*a* and 12*b* also project slightly upwardly beyond the sole plate 15 so that a completely saticfactory rotary guidance is assured during the release operation. The height of the extensions 12*a* and 12*b*, however, must not be so large that the ski boot to be arranged on the sole plate 15 will be contacted.

Figure 7:
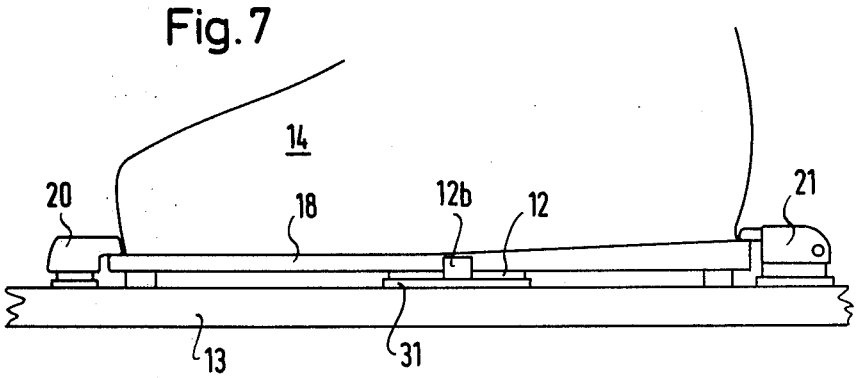
FIG. 7 is a side elevational view of a further simplified embodiment of a safety ski binding according to the present invention.
Figure 8:
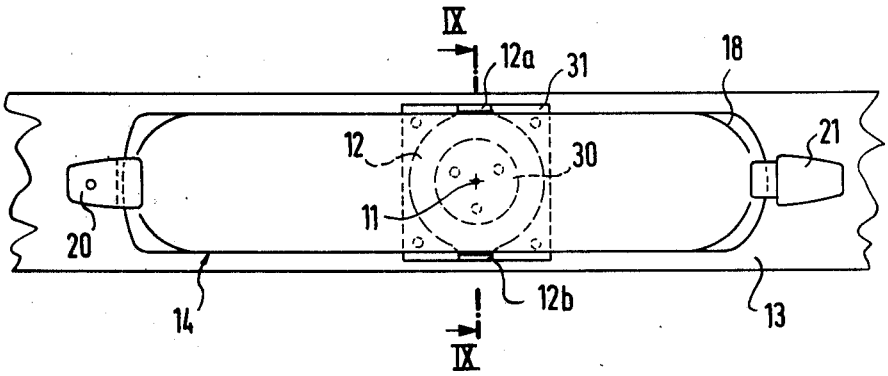
FIG. 8 is a plan view of the safety ski binding of FIG. 7.
Figure 9:
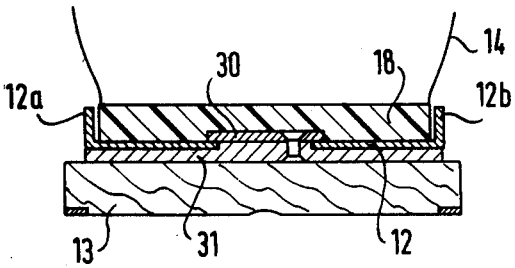
FIG. 9 is a cross-sectional view taken along line IX—IX of FIG. 8.

In the embodiment according to FIGS. 7 to 9, the sole plate is omitted. In lieu thereof, the lateral extensions 12*a* and 12*b* of the retaining member constructed as rotary plate 12 engage directly at the side edges of the ski boot 14, i.e., at the side edges of the boot sole 18. Also in this case, a completely satisfactory guidance of the ski boot 14 in the longitudinal direction is assured with a boot sole 18 extending parallel to the longitudinal direction, without impairing the movability in the longitudinal direction which is required in case of a sliding, forward fall. Also, an unequivocal pivot point exists during a lateral release, and the lifting off of the ski boot 14 from the retaining member 12 is assured without impairment.

Both in the embodiment according to FIGS. 4 to 6 and in the embodiment according to FIGS. 7 to 9, the rotary disk or plate 12 rests on a base plate 31 secured to the ski. However, the arrangement of the retaining member 12 may also be constructed without any difficulty according to FIGS. 1 to 3.

Figure 10:
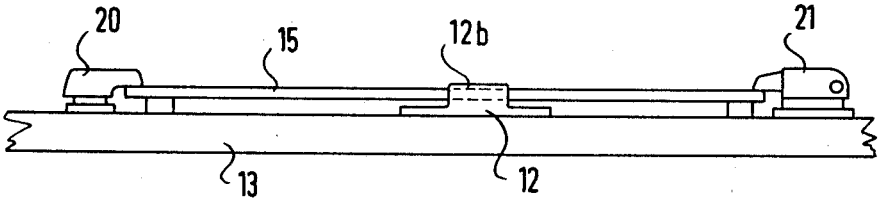
FIG. 10 is a side elevational view of a still further advantageous embodiment of a safety ski binding according to the present invention.
Figure 11:
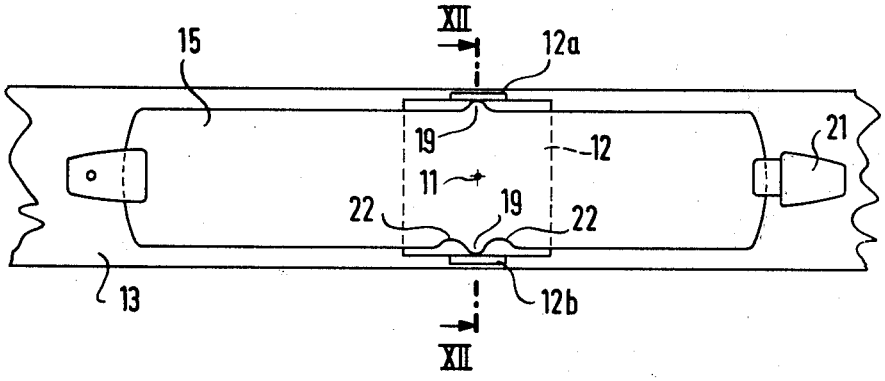
FIG. 11 is a plan view of the safety ski binding according to FIG. 10.
Figure 12:
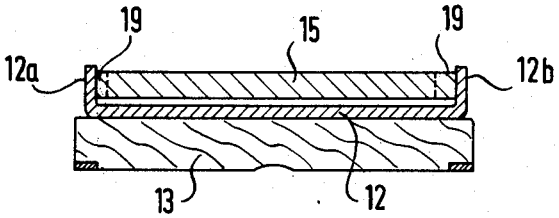
FIG. 12 is an enlarged cross-sectional view taken along line XII—XII of FIG. 11.

FIGS. 10 to 12 illustrate a particularly advantageous embodiment. In this embodiment, the means for fastening the boot to the sole plate 15 are not illustrated for the sake of simplicity. The fastening of the sole plate 15 may be constructed in all embodiments according to the teachings of FIGS. 1 to 3 or according to any other known equivalent arrangement.

In the embodiment according to FIGS. 10 to 12, the retaining member 12 together with the lateral extensions 12*a* and 12*b* is rigidly secured on the ski surface. The lateral edges of the sole plate 15 are provided within the area of the extensions 12*a* and 12*b* with one laterally projecting lug or tab 19 each, which is rounded off and which abuts with a sliding seat at the inner wall of the extensions 12*a* and 12*b*. In FIG. 11, two different embodiments of the lugs 19 are illustrated. With the lower construction, recesses 22 are provided adjacent the lugs in front and to the rear thereof, which are intended to avoid a collision of the extension 12*b* with the lateral edge of the sole plate 15 during a twisting of the sole plate about the vertical axis 11. The dimensions of the recesses 22 are matched to the release characteristics of the forward and rear retaining mechanisms 20 and 21.

As can be seen, in the just-described embodiment, a pivot bearing support is not necessary. By reason of the contact of the extensions and of the lugs 19, a pivot point is nonetheless defined and therefore exists in a completely satisfactory manner at the moment of the lateral release. The longitudinal displaceability also is present as also the ability to lift-off in the upward direction.

Figure 13:
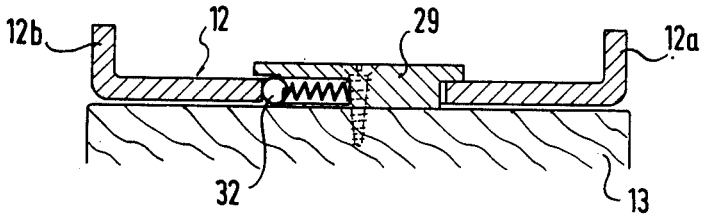
FIG. 13 is a schematic cross-sectional view of a preferred embodiment of a retaining member for the safety ski binding according to the present invention.
Figure 14:
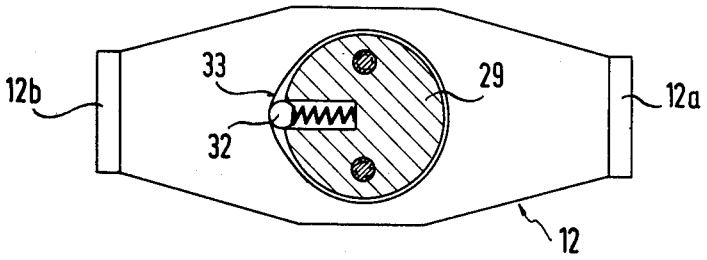
FIG. 14 is a plan view of the retaining member of FIG. 13.
Figure 15:
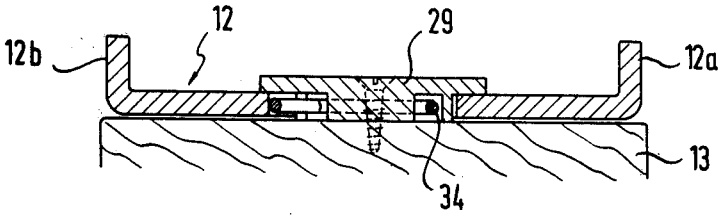
FIG. 15 is a schematic cross-sectional view of a preferred rotary plate or disk for the retaining member of the safety ski binding according to the present invention.
Figure 16:
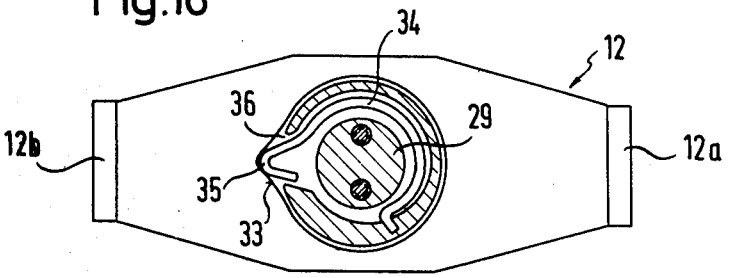
FIG. 16 is a horizontal cross-sectional view through FIG. 15 whereby also the retaining member is illustrated.

In the embodiments according to FIGS. 13 to 16, the essentially U-shaped retaining member 12 is rotatably secured to the ski 13 in such a manner that it is prestressed into its normal position which can be seen from FIGS. 14 and 16. This is achieved in the embodiment according to FIGS. 13 and 14 in that according to the present invention, a prestressed ball 32 prestressed by a spring and provided in the pivot pin 29, is pressed outwardly into a cam track or surface 33 which must have its lowest or deepest position located opposite the ball 32 when the retaining member 12 is in its normal position, and which is so inclined toward the sides, i.e., toward the front and toward the rear, that during a deflection of the retaining member 12 out of its normal position, a returning moment is transmitted from the ball 32 to the cam surface 33.

In the embodiment according to FIGS. 15 and 16, the spring-loaded ball 32 of FIGS. 13 and 14 is replaced by a strong wire spring 34, which is located within an appropriate recess or opening in the pivot pin 29 as shown, is anchored in the pivot pin with its inner end and projects outwardly through opening 36 with its V-shaped engaging end 35 to engage with the cam shaped wall surface 33 so that a return moment is produced when the spring end 35 is deflected radially inwardly and is stressed during rotation of the retaining member 12.

In the embodiment according to FIGS. 17 to 20, a base plate 111 is fixedly connected with the ski 110, for example, by means of screws, and a bearing pin 112 having a cover plate 113 is fixedly connected with the base plate 111, for example, is threadably connected therewith. A rotary disk or plate 114 serving as retaining member is rotatably supported on the pivot pin 112, axially secured by the cover plate 113; the rotary disk 114 is provided with lateral fork-like or cup-like extensions 115 on both sides of the ski longitudinal axis. The rotary disk 114 serves for the accommodation of a sole plate 116 which is equipped with lateral entrainment elements 117, for example, with claw-like or pin-like entrainment elements, by means of which it is adapted to be coupled with the rotary disk 114 in that the entrainment elements 117 are inserted from above into the extensions 115 which are open slot-shaped toward the ski center and are open in the upward direction; the forward and rearward walls 115*a* and 115*b* of the extensions 115 are constructed bent with a spacing from one another that increases in the upward direction, in such a manner that their center point of curvature is disposed in a forward and rearward area of the sole plate 116, respectively. The sole plate 116 is thereby coupled with the rotary disk 114 for entrainment in the direction of rotation about the axis a-a perpendicular to the ski surface and can simultaneously be secured against a displacement in the longitudinal direction of the ski. However, it may pivot together with the rotary disk 114 about the axis *a—a*. In order to normally prevent a lifting off of the sole plate 116 which may additionally be supported with respect to the ski at 118, 119, a forward retaining mechanism 120 is provided which is adapted to be pivoted, for example, against a detent action, about the axis *x* toward the one or other side and which advantageously permits a disengagement or release of the sole plate in the upward direction, and a rear retaining mechanism 121 is provided, for example, in the form of a heel support mechanism, which is able to release the sole plate 116 both in the lateral upward directions as in case of strong upwardly directed vertical forces, in that the hold-down member is able to pivot up, for example, about a cross axis *y* against detent action. As a result of the bent walls 115*a* and 115*b* of the extensions 115, the entrainment elements 117 of the sole plate 116 are able to leave the extensions 115 unimpaired in the direction of arrow $z_1$ or $z_2$ when the sole plate during a forward fall supports itself with its forward end on the ski or during a rearward fall with its rear end on the ski.

By reason of the construction of the rotary disk 124 with lateral extensions 115 visible from above as counter-entrainment elements for the lateral entrainment elements 117 mounted or provided at the sole plate 116, an easy stepping in of the skier by means of the sole plate clamped to the boot is made possible.

Possibly also a reverse arrangement may be provided in such a manner that the sole plate includes extensions (corresponding to 115) and the rotary disk includes entrainment elements (corresponding to 117).

While I have shown and described several embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

What I claim is:

1. A safety ski binding with at least one of forward and rear retaining mechanisms operable to releasably hold a ski boot that is adapted to be rotatably supported on the ski, against a lifting off from the ski and against lateral deflections, wherein a retaining means is provided for the rotatable bearing support of the ski boot about an axis substantially perpendicular to the ski surface, said retaining means which is rotatably supported on the ski about said axis and includes lateral extensions, being operable to hold the ski boot by means of said lateral extensions against a lateral displacement in the transverse direction of the ski, the lateral extensions being operable to couple with each other the retaining means and the ski boot in the direction of rotation, yet permit a lifting off of the ski boot in a direction substantially perpendicular to the ski, wherein the ski boot is retained on the ski by the retaining mechanisms by way of a sole plate means adapted to be clamped to the boot, wherein the lateral extensions surround the sole plate means on both sides, and wherein the lateral extensions engage into lateral notches of the sole plate means.

2. A safety ski binding according to claim 1, wherein both a forward and rearward release mechanism is provided.

3. A safety ski binding according to claim 1, wherein the extensions are visible from above with a mounted ski boot and are constructed to permit a free insertion from above the ski boot.

4. A safety ski binding according to claim 1, wherein the retaining means rotatably supported at the ski has a play in the ski longitudinal direction which enables a longitudinal displacement of the ski boot in relation to the ski.

5. A safety ski binding according to claim 1, wherein the lateral upright extensions are disposed directly adjacent the lateral edges of the sole plate means.

6. A safety ski binding according to claim 1, wherein the retaining means includes intermediate the extensions, a plate area which is disposed in a corresponding recess in the bottom side of the sole plate means.

7. A safety ski binding according to claim 1, wherein the pivot axis is disposed in the rear half of the sole plate means.

8. A safety ski binding according to claim 7, wherein the pivot axis is located in the forward area of the rear half of the sole plate means.

9. A safety binding according to claim 1, wherein the retaining means essentially consists of synthetic resinous material.

10. A safety ski binding with at least one of forward and rear retaining mechanisms operable to releasably hold a ski boot that is adapted to be rotatably supported on the ski, against a lifting off from the ski and against lateral deflections, wherein a retaining means is provided for the rotatable bearing support of the ski boot about an axis substantially perpendicular to the ski surface, said retaining means which is rotatably supported on the ski about said axis and includes lateral extensions, being operable to hold the ski boot by means of said lateral extensions against a lateral displacement in the transverse direction of the ski, the lateral extensions being operable to couple with each other the retaining means and the ski boot in the direction of rotation, yet permit a lifting off of the ski boot in a direction substantially perpendicular to the ski, further comprising prestressing means for prestressing the retaining means into its normal position, wherein the ski boot is retained at the ski by the retaining mechanisms by way of a sole plate means adapted to be clamped to the boot, and wherein the lateral extensions surround the sole plate means on both sides, wherein the extensions are visible from above with a mounted ski boot and are constructed to permit a free insertions from above of the sole plate means, wherein the retaining means rotatably supported at the ski has a play in the ski longitudinal direction which enables a longitudinal displacement of the ski boot in relation to the ski, wherein the lateral upright extensions are disposed directly adjacent the lateral edges of the sole plate means, and wherein the retaining means includes intermediate the extensions, a plate area which is disposed in a corresponding recess in the bottom side of the sole plate means.

11. A safety ski binding according to claim 10, wherein the lateral extensions extend over such a length that they serve as longitudinal guide means for the sole plate means.

12. A safety ski binding according to claim 11, wherein the pivot axis is disposed in the rear half of the sole plate means.

13. A safety ski binding according to claim 12, wherein the pivot axis is located in the forward area of the rear half of the sole plate means.

14. A safety ski binding according to claim 13, wherein the retaining means essentially consists of synthetic resinous material.

15. A safety ski binding with at least one of forward and rear retaining mechanisms operable to releasably hold a ski boot that is adapted to be rotatably supported on the ski, against a lifting off from the ski and against lateral deflections, wherein a rotatable retaining means is provided for the rotatable bearing support of the ski boot about an axis substantially perpendicular to the ski surface, said retaining means which is rotatably supported on the ski about said axis and includes lateral extensions, being operable to hold the ski boot by means of said lateral extensions against a lateral displacement in the transverse direction of the ski, the lateral extensions being operable to couple with each other the retaining means and the ski boot in the direction of rotation, yet permit a lifting off of the ski boot in a direction substantially perpendicular to the ski, further comprising prestressing means for prestressing the retaining means into its normal position, wherein said retaining means is rotatably supported on said ski by a pin means extending through an aperture in said retaining means with an internal circular shaped peripheral surface of said aperture being rotatably guided and supported on a concentric external circular shaped peripheral surface of said pin means, wherein one of said internal peripheral surface and said external peripheral surface exhibits a cam-shaped recess which extends over a portion of the respective peripheral surface and is joined by the remaining circular portion of the respective peripheral surface, and wherein the prestressing means includes a spring biased stop element guidably disposed in the other of said peripheral surfaces, said stop element being engaged in said cam-shaped recess when said retaining means is in its normal position.

16. A safety ski binding according to claim 15, wherein the ski boot is retained at the ski by the retaining mechanisms by way of a sole plate means adapted to be clamped to the boot, and wherein the lateral extensions surround the sole plate means on both sides.

17. A safety ski binding according to claim 16, wherein the extensions are visible from above with a mounted ski boot and are constructed to permit a free insertion from above of the sole plate means.

18. A safety ski binding according to claim 17, wherein the retaining means is constructed as substantially round rotary disk.

19. A safety ski binding according to claim 17, wherein the retaining means rotatably supported at the ski has a play in the ski longitudinal direction which enagles a longitudinal displacement of the ski boot in relation to the ski.

20. A safety ski binding according to claim 19, wherein the retaining means is constructed as substantially round rotary disk.

21. A safety ski binding according to claim 19, wherein the lateral upright extensions are disposed directly adjacent the lateral edges of the sole plate means.

22. A safety ski binding according to claim 21, wherein the extensions contact the side edges of the sole plate means.

23. A safety ski binding according to claim 15, wherein said presetting means includes a spring biased member engageable in a detent provided on said retaining means.

24. A safety ski binding according to claim 15, wherein said prestressing means includes a wire spring engaged in a detent provided on said retaining means, said wire spring partially surrounding and being supported on a pivot pin fixed to the ski.

25. A safety ski binding with at least one of forward and rear retaining mechanisms operable to releasably hold a ski boot that is adapted to be rotatably supported on the ski, against a lifting off from the ski and against lateral deflections, wherein a retaining means is provided for the rotatable bearing support of the ski boot about an axis substantially perpendicular to the ski surface, said retaining means which is supported on the ski and includes lateral extensions, being operable to hold the ski boot by means of said lateral extensions against a lateral displacement in the transverse direction of the ski, the lateral extensions being operable to couple with each other the retaining means and the ski boot in the direction of rotation, yet permit a lifting off of the ski boot in a direction substantially perpendicular to the ski, wherein the ski boot is retained on the ski by the retaining mechanisms by way of a sole plate means adapted to be clamped to the boot, wherein the lateral extensions surround the sole plate means on both sides, and wherein the retaining means is fixedly arranged on the ski and the lateral extensions cooperate with rounded off lateral projecting lugs on the sole plate means.

26. A safety ski binding according to claim 25, wherein the extensions contact the side edges of the sole plate means.

27. A safety ski binding according to claim 25, wherein the lateral extensions extend over such a length that they serve as a longitudinal guide means for the sole plate means.

28. A safety ski binding according to claim 25, wherein lateral recesses are provided in the sole plate means in front of and to the rear of the lugs.

29. A safety ski binding with at least one of forward and rear retaining mechanisms operable to releasably hold a ski boot that is adapted to be rotatably supported on the ski, against a lifting off from the ski and against lateral deflections, wherein a retaining means is provided for the rotatable bearing support of the ski boot about an axis substantially perpendicular to the ski surface, said retaining means which is rotatably supported on the ski about said axis and includes lateral extensions, being operable to hold the ski boot by means of said lateral extensions against a lateral displacement in transverse direction of the ski, the lateral extensions being operable to couple with each other the retaining means and the ski boot in the direction of rotation, yet permit a lifting off of the ski boot in a direction substantially perpendicular to the ski, wherein the ski boot is retained on the ski by the retaining mechanisms by way of a sole plate means adapted to be clamped to the boot, wherein the lateral extensions surround the sole plate means on both sides, and wherein one of the two parts consisting of retaining means and sole plate means is provided on both sides of the ski with upwardly directed extensions into which lateral entrainment means of the other one of said two parts consisting of retaining means and sole plate means are adapted to be freely inserted from above.

30. A safety ski binding according to claim 29, wherein the retaining means is constructed as substantially round rotary disk.

31. A safety ski binding according to claim 29, wherein the extensions are fork-shaped.

32. A safety ski binding according to claim 29, wherein the extensions are cup-shaped.

33. A safety ski binding according to claim 29, wherein the sole plate means is provided with the extensions while the retaining means is provided with the entrainment means.

34. A safety ski binding according to claim 39, wherein the retaining means is provided with the extensions and the sole plate means is provided with the entrainment means.

35. A safety ski binding according to claim 29, wherein the extensions are formed by upwardly and inwardly bent walls which are open toward the inside and at the top and are closed toward the outside.

36. A safety ski binding according to claim 35, wherein said walls are made from sheet metal material.

37. A safety ski binding according to claim 35, wherein the extensions are delimited in at least one of forward and rearward directions by curved walls whose center point of curvature is located within the area of the corresponding end of one of the two parts consisting of ski boot and sole plate means.

38. A safety ski binding according to claim 37, wherein the extensions are delimited in the forward and rearward direction by arcuately shaped walls whose center point of curvature is disposed within the area of the forward and rearward end of one of the two parts consisting of ski boot and sole plate means.

39. A safety ski binding according to claim 29, wherein the extensions are delimited in at least one of forward and rearward directions by curved walls whose center point of curvature is located within the area of the corresponding end of one of the two parts consisting of ski boot and sole plate means.

40. A safety ski binding according to claim 29, wherein the extensions are delimited in the forward and rearward direction by arcuately shaped walls whose center point of curvature is disposed within the area of the forward and rearward end of one of the two parts consisting of ski boot and sole plate means.

* * * * *